US010905193B2

(12) United States Patent
Rehagen

(10) Patent No.: US 10,905,193 B2
(45) Date of Patent: Feb. 2, 2021

(54) FOOTWEAR SOLE STRUCTURE HAVING BLADDER WITH INTEGRATED OUTSOLE

(71) Applicant: NIKE, Inc., Beaverton, OR (US)

(72) Inventor: Christopher Conrad Rehagen, Saint Charles, MO (US)

(73) Assignee: NIKE, Inc., Beaverton, OR (US)

( * ) Notice: Subject to any disclaimer, the term of this patent is extended or adjusted under 35 U.S.C. 154(b) by 111 days.

(21) Appl. No.: 16/401,472

(22) Filed: May 2, 2019

(65) Prior Publication Data

US 2019/0254382 A1 Aug. 22, 2019

Related U.S. Application Data

(62) Division of application No. 15/553,066, filed as application No. PCT/US2016/028386 on Apr. 20, 2016, now Pat. No. 10,327,504.

(60) Provisional application No. 62/152,346, filed on Apr. 24, 2015.

(51) Int. Cl.

| | |
|---|---|
| ***A43B 13/20*** | (2006.01) |
| ***A43B 13/12*** | (2006.01) |
| ***A43B 13/22*** | (2006.01) |
| ***A43B 13/18*** | (2006.01) |

(52) U.S. Cl.

CPC ..... *A43B 13/122* (2013.01); *A43B 13/181* (2013.01); *A43B 13/187* (2013.01); *A43B 13/20* (2013.01); *A43B 13/223* (2013.01); *A43B 13/186* (2013.01)

(58) Field of Classification Search

CPC ..... A43B 13/20; A43B 1/122; A43B 13/223
USPC ..... 36/134, 29
See application file for complete search history.

(56) References Cited

U.S. PATENT DOCUMENTS

| | | | | |
|---|---|---|---|---|
| 6,158,149 | A * | 12/2000 | Rudy | A43B 7/144 36/29 |
| 7,784,196 | B1 * | 8/2010 | Christensen | A43B 13/26 36/29 |
| 10,327,504 | B2 * | 6/2019 | Rehagen | A43B 13/181 |
| 2012/0144695 | A1 * | 6/2012 | McDowell | A43B 13/36 36/28 |
| 2013/0326908 | A1 * | 12/2013 | Grott | A43B 5/001 36/62 |

(Continued)

FOREIGN PATENT DOCUMENTS

| | | | |
|---|---|---|---|
| CN | 1383363 | A | 12/2002 |
| CN | 1901822 | A | 1/2007 |
| CN | 101291796 | A | 10/2018 |

*Primary Examiner* — Marie D Bays
(74) *Attorney, Agent, or Firm* — Quinn IP Law

(57) ABSTRACT

A sole structure for an article of footwear comprises a bladder having a first side formed from a first polymeric sheet and a second side formed from a second polymeric sheet. The first and second polymeric sheets define a closed volume between the first side and the second side. The second polymeric sheet at least partially defines an outsole at the second side of the bladder. The outsole includes a ground-contacting surface and a plurality of lugs. The first polymeric sheet includes a portion that extends from the first side of the bladder and is fused to the second polymeric sheet opposite the ground-contacting surface at the one of the plurality of lugs, and further defines the one of the plurality of lugs. A method of manufacturing the sole structure comprises forming the bladder and fusing the portion of the first polymeric sheet to the second polymeric sheet.

13 Claims, 4 Drawing Sheets

(56) References Cited

U.S. PATENT DOCUMENTS

| | | | | |
|---|---|---|---|---|
| 2013/0333247 | A1* | 12/2013 | Grott | A43C 9/00 36/127 |
| 2014/0123522 | A1* | 5/2014 | Rustam | A43B 7/144 36/127 |
| 2014/0259742 | A1* | 9/2014 | Wu | A43B 13/187 36/28 |
| 2014/0331517 | A1* | 11/2014 | Seo | A43B 13/20 36/28 |
| 2016/0192737 | A1* | 7/2016 | Campos, II | A43B 13/223 36/28 |
| 2017/0020228 | A1* | 1/2017 | Scofield | A43B 13/181 |
| 2017/0119095 | A1* | 5/2017 | Greene | B29D 35/142 |
| 2018/0035751 | A1* | 2/2018 | Rehagen | A43B 13/187 |
| 2018/0338578 | A1* | 11/2018 | Elder | A43B 3/0052 |

* cited by examiner

FOOTWEAR SOLE STRUCTURE HAVING BLADDER WITH INTEGRATED OUTSOLE

CROSS-REFERENCE TO RELATED APPLICATIONS

This application is a divisional of and claims the benefit of priority to U.S. application Ser. No. 15/553,066, filed Aug. 23, 2017, which is a National Stage Entry of and claims the benefit of priority to International Application No. PCT/US2016/028386, filed Apr. 20, 2016, which claims the benefit of priority to U.S. Provisional Application No. 62/152,346 filed Apr. 24, 2015, each of which is hereby incorporated by reference in its entirety.

TECHNICAL FIELD

The present teachings generally include a footwear sole structure including a bladder.

BACKGROUND

Footwear typically includes a sole structure configured to be located under a wearer's foot to space the foot away from the ground or floor surface. Footwear sometimes utilizes polyurethane foam or other resilient materials in the sole to provide cushioning. A fluid-filled bladder is sometimes included in the sole to provide desired cushioning. An outsole of a durable material, such as rubber, is typically adhered to the foam and/or the bladder and serves as a ground-contacting surface with sufficient traction coefficients under both wet and dry conditions.

DESCRIPTION

Figure 1:
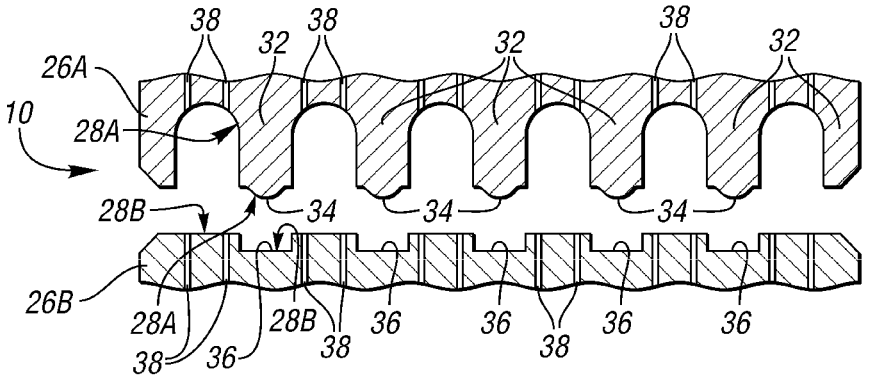
FIG. 1 is a schematic cross-sectional illustration of a mold assembly for forming a bladder.

Typically, a bladder is produced by a twin sheet thermoforming process, and an outsole is separately produced by injection molding or compression molding from vulcanized rubber. An adjoining process for the bladder and the outsole is then required, which involves chemical cleaning of both components, priming while heating, adhesive application with heat, fitting and final assembly with pressure and heat.

The bladder described herein includes an integral outsole. When produced under the method described herein, the bladder and outsole result from a single forming process, alleviating many of the typical production steps for a sole structure with a bladder and an outsole. Production efficiencies are thus likely increased.

More specifically, a sole structure for an article of footwear comprises a bladder having a first side formed from a first polymeric sheet and a second side formed from a second polymeric sheet. The first polymeric sheet and the second polymeric sheet define a closed volume between the first side and the second side. The second polymeric sheet at least partially defines an outsole at the second side of the bladder. The outsole includes a ground-contacting surface and a plurality of lugs. The first polymeric sheet includes a portion that extends from the first side of the bladder and is fused to the second polymeric sheet opposite the ground-contacting surface at the one of the plurality of lugs, the portion further defining the one of the plurality of lugs. For example, the first polymeric sheet may be fused to the second polymeric sheet by either or both of compression molding and thermal bonding. Stated differently, the one of the plurality of lugs extends at the ground-facing surface of the second polymeric sheet, and the first polymeric sheet is fused to an inner surface of the second polymeric sheet at the one of the plurality of lugs. In an embodiment, the first polymeric sheet may be fused to the second polymeric sheet at each of the plurality of lugs.

In an embodiment, the second polymeric sheet includes a thermoplastic polymer, and the outsole does not include rubber. Each of the first polymeric sheet and the second polymeric sheet may respectively include a thermoplastic polyurethane material. The closed volume may contain a fluid having a positive pressure relative to a standard atmospheric pressure.

The sole structure may include a polymeric foam layer in contact with the first polymeric sheet. The polymeric foam layer and the second polymeric sheet are disposed on opposite sides (i.e., on opposite surfaces) of the first polymeric sheet. The portion of the first polymeric sheet that is fused to the second polymeric sheet opposite one of the plurality of lugs defines a concave recess extending from the first side. The polymeric foam layer fills the concave recess.

In an embodiment, the first polymeric sheet extends within a recess of the second polymeric sheet at the one of the plurality of lugs. For example, the one of the plurality of lugs may have a volume that is from about 10% to about 50% formed from the first polymeric sheet. In an embodiment, each of the plurality of lugs has a solid portion having a height of from about 1 mm to about 5 mm.

The first polymeric sheet may include an impressed area that is centrally located within the portion that is fused to the second polymeric sheet. The impressed area may extend further toward the second side than a remainder of the fused portion.

A method of manufacturing a sole structure for an article of footwear includes forming a bladder having a first side formed from a first polymeric sheet and a second side formed from a second polymeric sheet. The first polymeric sheet and the second polymeric sheet define a closed volume between the first side and the second side. The second polymeric sheet at least partially defines an outsole at the second side of the bladder, and the outsole includes a ground-contacting surface and a plurality of lugs. The method includes fusing a portion of the first polymeric sheet to the second polymeric sheet. The fused portion extends from the first side of the bladder and is fused to the second polymeric sheet opposite the ground-contacting surface at the one of the plurality of lugs, so that the portion of the first polymeric sheet and the second polymeric sheet define the one of the plurality of lugs.

In an embodiment, fusing the portion of the first polymeric sheet to the second polymeric sheet may include compression molding the portion of the first polymeric sheet to the second polymeric sheet. For example, in an embodiment, compression molding the portion of the first polymeric sheet to the second polymeric sheet may include mechanically urging the portion of the first polymeric sheet against the second polymeric sheet to form the one of the plurality of lugs. Compression molding the portion of the first polymeric sheet to the second polymeric sheet may further include indenting the portion of the first polymeric sheet with a mold protrusion so that the indenting mechanically urges the first polymeric sheet and the second polymeric sheet to form the one of the plurality of lugs. In an embodiment, the compression molding causes the one of the plurality of lugs to have a volume that is from about 10% to about 50% formed from the first polymeric sheet.

In an embodiment in which each of the first polymeric sheet and the second polymeric sheet respectively includes a thermoplastic polymer, fusing a portion of the first polymeric sheet to the second polymeric sheet may include thermally bonding the first polymeric sheet to the second polymeric sheet.

Furthermore, forming the bladder may include vacuum forming the first polymeric sheet, and vacuum forming the second polymeric sheet to form the second side of the bladder and to at least partially define the plurality of lugs.

The method may further comprise providing a polymeric foam layer in contact with the first polymeric sheet and on an opposite side of the first polymeric sheet from the second polymeric sheet. In an embodiment, the portion of the first polymeric sheet that is fused to the second polymeric sheet forms a concave recess extending from the first side, and providing the polymeric foam layer includes filling the concave recess with a foamed polymeric material.

The method may further comprise pressurizing the closed volume, such as with a fluid that may be air or another gas.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Figure 5:
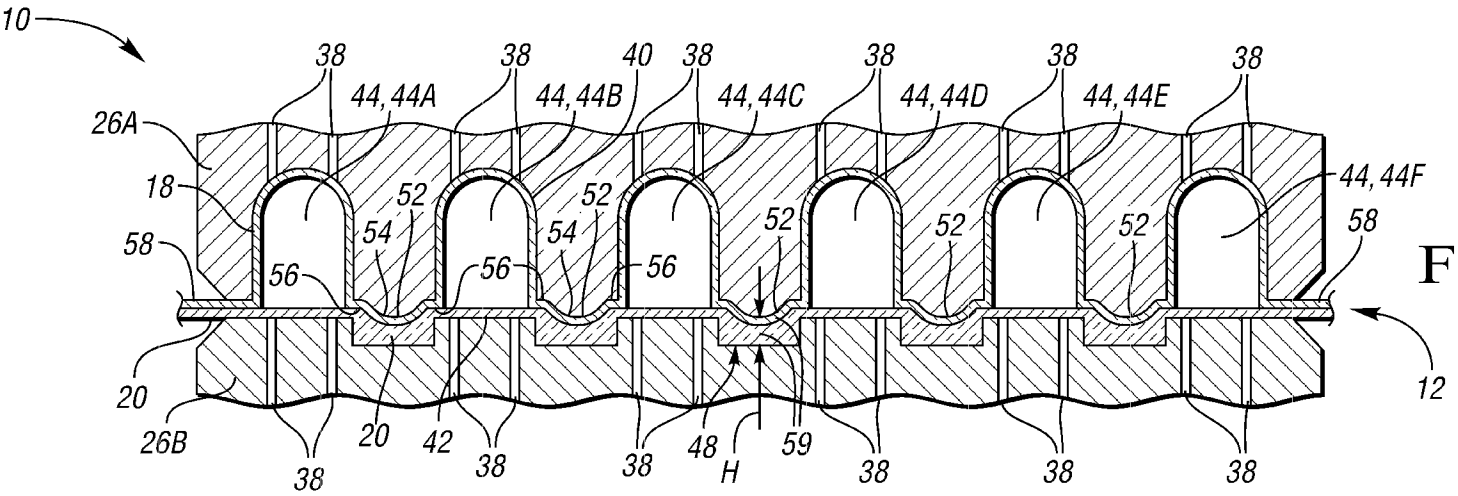
FIG. 5 is a schematic cross-sectional illustration of the mold assembly of FIG. 4 in a closed position forming the polymeric sheets into a bladder with an integral outsole.
Figure 6:
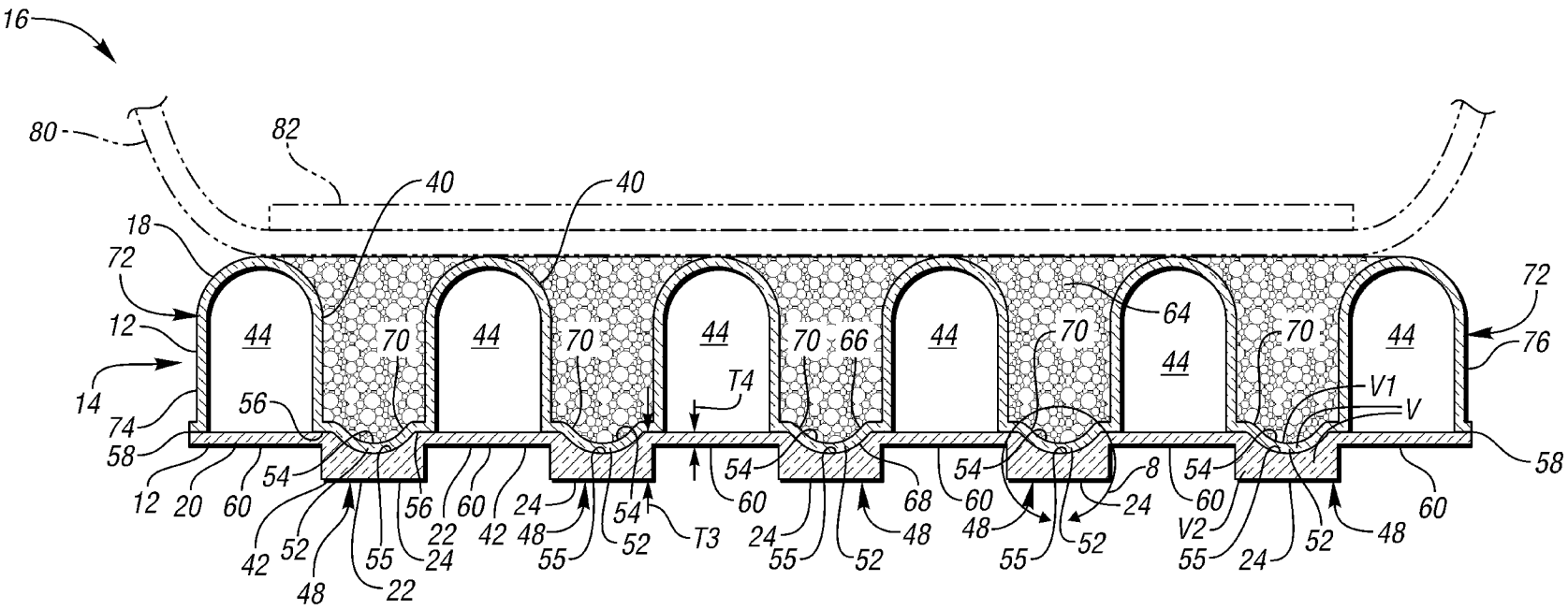
FIG. 6 is a schematic illustration in cross-sectional view taken at lines 6-6 in FIG. 7 of an article of footwear with a sole structure including the bladder of FIG. 5 and showing an upper and insole with phantom lines.

Referring to the drawings, wherein like reference numbers refer to like components, FIG. 1 shows a mold assembly 10 used to form a bladder 12 (shown in FIGS. 5 and 6) that can be included in a sole structure 14 of an article of footwear 16 (shown in FIG. 6). As further discussed herein, the bladder 12 is formed from a first polymeric sheet 18 and a second polymeric sheet 20, and the second polymeric sheet 20 also at least partially defines an outsole 22 having a plurality of lugs 24. The lugs 24 are formed from the first and second polymeric sheets 18, 20. Stated differently, the bladder 12 includes an integral outsole 22. The outsole 22 is formed entirely from the material of the first polymeric sheet 18 and the second polymeric sheet 20, and in the embodiment shown does not include rubber.

The mold assembly 10 includes a first or an upper mold portion 26A and a second or lower mold portion 26B. The upper mold portion 26A has a first mold surface 28A against which the first polymeric sheet 18 is formed. The upper mold portion 26A includes a plurality of spaced posts 32 that partially define the first mold surface 28A. Each post 32 has a mold protrusion 34 that forms a distal tip of the post 32.

The lower mold portion 26B has a second mold surface 28B against which the second polymeric sheet 20 is formed. The lower mold portion 26B includes a plurality of spaced recesses 36 that partially define the second mold surface 28B. As is apparent in FIG. 1, the mold portions 26A, 26B are configured so that the posts 32 generally align with the recesses 36. More specifically, each post 32 generally aligns with a respective different one of the recesses 36 so that the protrusion 34 will extend toward the bottom of the recess 36 when the mold portions 26A, 26B are moved from an open position shown in FIGS. 1 and 4 to a closed position shown in FIG. 5.

In the embodiment shown in FIGS. 1-8, the posts 32, the recesses 36, and the resulting lugs 24 are generally round, and each post 32 aligns with a single recess 36. In other embodiments, the recesses 36 and posts 32 could have different shapes, such as but not limited to square, rectangular, or other polygonal shapes. Additionally, the recess 36 could be shaped so that the second mold surface 28B forms a cluster of several grouped smaller sub-recesses. A single one of the posts 32 aligned with such a recess would function to fuse the second polymeric sheet 20 to the first polymeric sheet 18 at each of the sub-recesses, resulting in multiple clustered lugs. For example, in one embodiment, the sub-recesses could be arranged in a linear formation within a single recess, and a single post 32 would thus fuse the second polymeric sheet 20 to the first polymeric sheet 18 within the recess 36 to form a row of lugs defined by the sub-recesses. The single post 32 and the recesses 36 in such an embodiment, could, for example, be rectangular in shape. In another embodiment, the posts 32 and the recesses 36 could remain generally round, with the recesses 36 each having sub-recesses arranged in a circle or other pattern.

Vacuum ports 38 are spaced about the mold portions 26A, 26B and open at the mold surfaces 28A, 28B. Only some of the vacuum ports 38 are indicated with a reference number in FIG. 1. The arrangement of the vacuum ports 38 is for purposes of illustration of only one possible embodiment. The vacuum ports 38 may be distributed and arranged in a variety of other patterns.

A method of manufacturing the sole structure 14 includes forming the bladder 12 using the mold assembly 10. When formed according to the method, and with reference to FIGS. 5 and 6, the bladder 12 has a first side 40 formed from the first polymeric sheet 18 and a second side 42 formed from the second polymeric sheet 20. Additionally, the first polymeric sheet 18 and the second polymeric sheet 20 define a closed volume 44, also referred to herein as a fluid-filled chamber, between the first side 18 and the second side 20. As indicated in FIGS. 5 and 6, the closed volume 44 is separated into a plurality of discreet sub chambers 44A, 44B, 44C, 44D, 44E, and 44F. The sub chambers may be isolated from one another by fused portions of the polymeric sheets 18, 20. Alternatively, some or all of the sub chambers may be in fluid communication with one another if the mold assembly 10 is configured to form the first and second polymeric sheets 18, 20 with connecting channels or conduits (not shown) connecting adjacent ones of the sub chambers.

The second polymeric sheet 20 as formed partially defines the integral outsole 22 at the second side 42 of the bladder. In other words, the bladder 12 and outsole 22 are a unitary component, with the outsole 22 being a portion of the bladder 12. The outsole 22 includes a ground-contacting surface 48 and a plurality of lugs 24. The lugs 24 establish the ground-contacting surface 48, and can also be referred to as treads.

The first polymeric sheet 18 has fused portions 52 positioned under the posts 32. Each fused portion 52 extends from the first side 40 of the bladder 12 and is fused to the second polymeric sheet 20 opposite the ground-contacting surface 48 at a different respective one of the plurality of lugs 24. The posts 32 and the protrusions 34 cause the first polymeric sheet 18 to be formed with an impressed area 54 that is centrally located within the fused portion 52. A remainder 56 of the fused portion 52 of the first polymeric sheet 18 at one of the lugs 24 surrounds the impressed area 54. The remainder 56 is generally annular. As best shown in FIGS. 5 and 6, the impressed area 54 extends further toward the second side 42 than the remainder 56. The impressed area 54 extends into a recess 55 of the second polymeric sheet 20 that is created by the mechanical urging of the first polymeric sheet 18 at the fused portion 52. The first polymeric sheet 18 is also fused to the second polymeric sheet 20 at a periphery of the bladder 12, where the fused sheets 18, 20 create a peripheral flange 58 that surrounds the bladder 12 and further seals the enclosed volume 44. The sheets 18, 20 can be trimmed at the flange 58 after fusing and removal from the mold assembly 10.

The first and second polymeric sheets 18, 20 used to form the bladder 12 can each in turn be formed of layers of different materials. For example, the bladder 12 can be a laminate membrane formed from thin films having one or more thermoplastic polyurethane layers that alternate with one or more barrier layers. The barrier layers may also be referred to as gas barrier polymers, or gas barrier layers, and may comprise a copolymer of ethylene and vinyl alcohol (EVOH) that is impermeable to the pressurized fluid contained therein as disclosed in U.S. Pat. No. 6,082,025 to Bonk et al., which is incorporated by reference in its entirety. The fluid-filled bladder 12 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. For example, the bladder 12 may be a flexible microlayer membrane that includes alternating layers of a gas barrier polymer material and an elastomeric material, as disclosed in U.S. Pat. Nos. 6,082,025 and 6,127,026 to Bonk et al. which are incorporated by reference in their entireties. With such alternating layers, for example, the bladder 12 may have a gas transmission rate for nitrogen of less than 10 cubic centimeters per square meter per atmosphere per day, or of less than 1 cubic centimeter per square meter per atmosphere per day. In selecting materials for the bladder 12, engineering properties such as tensile strength, stretch properties, fatigue characteristics, dynamic modulus, and loss tangent can be considered. The thicknesses T1, T2 (see FIG. 4) of the first and second polymeric sheets 18, 20 used to form the bladder 12 can be selected to provide these characteristics.

Figure 4:
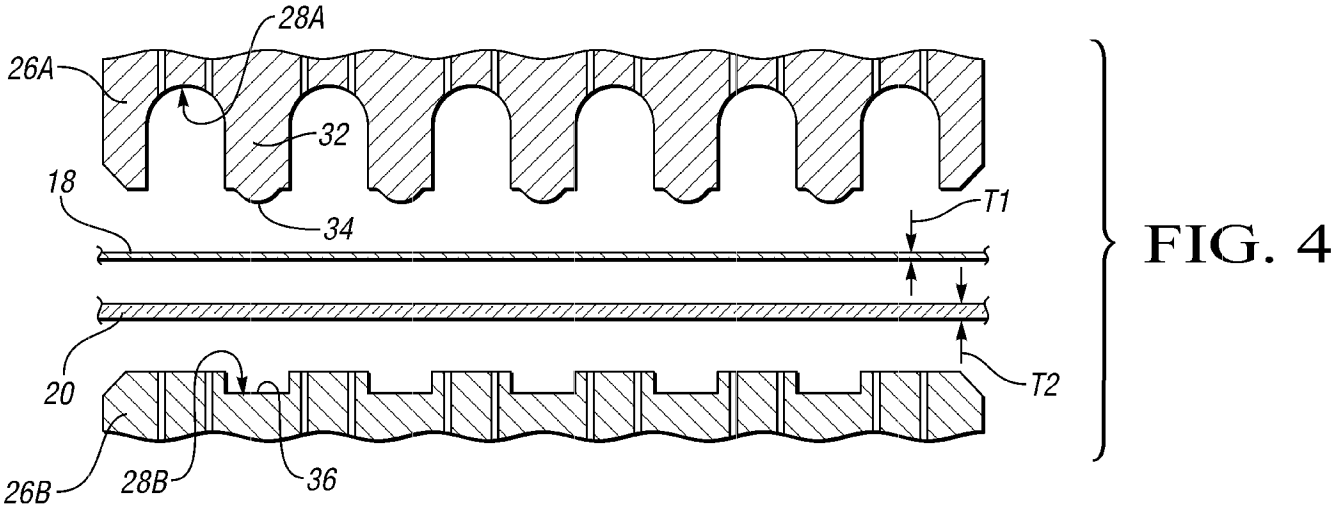
FIG. 4 is a schematic cross-sectional illustration of the mold assembly of FIG. 1 in an open position with polymeric sheets positioned between mold portions.

Under the method, the first polymeric sheet 18 and the second polymeric sheet 20 are placed between the mold portions 26A, 26B while the mold assembly 10 is in the open position. The first polymeric sheet 18 is placed adjacent the first mold portion 26A and the second polymeric sheet 20 is placed adjacent the second mold portion 26B as shown in FIG. 4. The first and second polymeric sheets 18, 20 may be heated prior to placement between the mold portions 26A, 26B in order to increase the flexibility and flowability of the polymeric material.

Next, the first polymeric sheet 18 is vacuum formed to the shape of the mold surface 28A by applying a vacuum through the vacuum ports 38 in the first mold portion 26A. FIG. 5 shows the first polymeric sheet 18 pulled against the first mold surface 28A by the vacuum. The first polymeric sheet 18 forms the first side 40 of the bladder 12. Similarly, the second polymeric sheet 20 is vacuum formed to the shape of the mold surface 28B by applying a vacuum through the vacuum ports 38 in the second mold portion 26B. FIG. 5 shows the second polymeric sheet 20 pulled against the second mold surface 28B by the vacuum. The second polymeric sheet 20 forms the second side 42 of the bladder 12 and at least partially defines the lugs 24.

The method also includes fusing the first polymeric sheet 18 to the second polymeric sheet 20 in the mold assembly 10 by compression molding and thermal bonding. Compression molding occurs when one or both of the mold portions 26A, 26B are translated toward one another to close together against the polymeric sheets 18, 20 with sufficient pressure to deform the polymeric sheets 18, 20. The pressure of the mold assembly 10 compresses the first polymeric sheet 18 against the second polymeric sheet 20 to cause fusing at the fused portion 52 and at the flange 58. Due to the elevated temperature of the sheets 18, 20, the sheets 18, 20 also fuse to one another due to thermal bonding. In other words, if the mold assembly 10 is held in the closed position as the sheets 18, 20 at least partially cool, the sheets 18, 20 fuse to one another at the fused portion 52 and at the flange 58.

Figure 2:
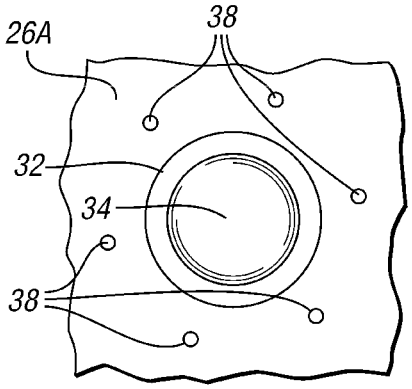
FIG. 2 is a schematic fragmentary illustration in bottom view of a portion of the mold assembly of FIG. 1.
Figure 3:
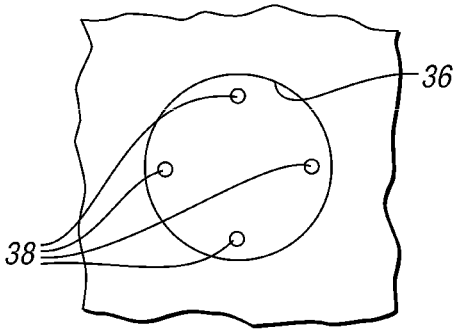
FIG. 3 is a schematic fragmentary illustration in plan view of another portion of the mold assembly of FIG. 1.

Compression molding the portion 52 of the first polymeric sheet 18 to the second polymeric sheet 20 further includes mechanically urging the portion 52 of the first polymeric sheet 18 against the second polymeric sheet 20 to form the plurality of lugs 24. The posts 32 and the protrusions 34 mechanically urge the portion 52 against the second polymeric sheet 20. Compression molding the portion 52 of the first polymeric sheet 18 to the second polymeric sheet 20 includes indenting the portions 52 of the first polymeric sheet 18 by the mold protrusions 34. The mold protrusions 34 are generally rounded, as shown in FIGS. 1 and 2, and urge the material of the second sheet 20 to fill the recesses 36 in order to form the lugs 24.

As is apparent in FIG. 4, the second polymeric sheet 20 as provided is thicker than the first polymeric sheet 18. The thickness T2 of the second polymeric sheet 20 is greater than the thickness T1 of the first polymeric sheet 18. For example, the thickness T2 of the second polymeric sheet 20 may be at least twice the thickness T1 of the first polymeric sheet 18. The greater thickness of the second polymeric sheet 20 enables it to deform through compression and thermal flow to fill the recesses 36 while not causing the remaining portions 60 of the second polymeric sheet 20 that do not form the lugs 24 to be excessively thinned. In other words, as illustrated in FIG. 6, the portions of the second polymeric sheet 20 at the lugs 24 have a thickness T3 thicker than the original thickness T2 of the second polymeric sheet 20, and the portions 60 of the second polymeric sheet 20 not at the lugs 24 have a thickness T4 that is thinner than the original thickness T2. The thickness T4 is great enough to provide sufficient durability for the outsole 22 as well as maintain the sealed volume 44.

Figure 8:
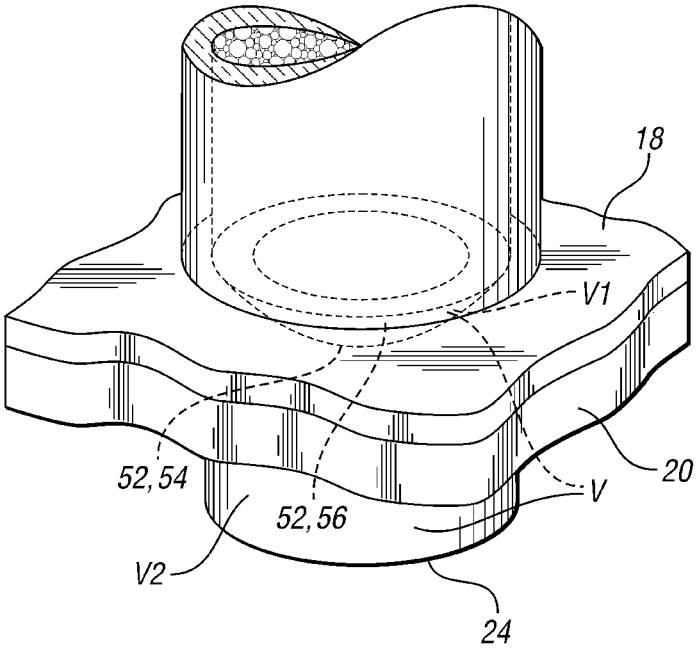
FIG. 8 is a schematic perspective fragmentary illustration of a portion of the bladder of FIG. 5.

With reference to FIGS. 5, 6 and 8, the relative thicknesses T1 and T2 of the first polymeric sheet 18 and the second polymeric sheet 20 may cause each lug 24 to have a total volume V that is from about 10% to about 50% formed from the first polymeric sheet 18. In other words, a volume V1 of the first polymeric sheet 18 at the lug 24 is about 10% to about 50% of the volume V of the lug 24, and the volume V2 of the second polymeric sheet 20 at the lug 24 is about 50% to about 90% of the volume V of the lug 24. Referring to FIG. 5, each of lugs 24 has a solid portion 59 having a height H of from about 1 mm to about 5 mm above the ground-contacting surface 48 of the second side 42 of the bladder 12. As indicated in FIG. 5, the solid portion 59 of the lug 24 includes both the first and the second polymeric sheets 18, 20, and the height H is the minimum height of the solid portion 59. The solid portion 59 does not include any of the foam layer 64 of FIG. 6.

Once the bladder 12 is formed through vacuum forming, compression molding, and thermal bonding, the bladder 12 can be removed from the mold assembly 10. The method may also include pressurizing the enclosed volume 44 to a positive pressure relative to a standard atmospheric pressure by inflating the enclosed volume with a fluid. As used herein, a "fluid" includes a gas, including air, an inert gas such as nitrogen, or another gas. Accordingly, "fluid-filled" includes "gas-filled".

Figure 7:
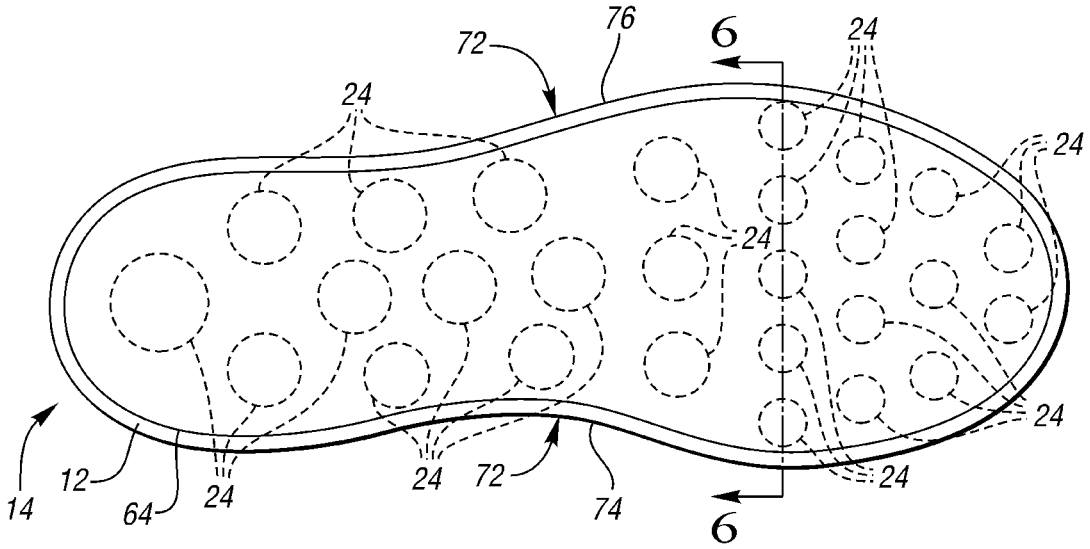
FIG. 7 is a schematic illustration in plan view of the sole structure of FIG. 6.

Optionally, a polymeric foam layer 64 may be provided in contact with the first polymeric sheet 18 and on a first side 66 of the first polymeric sheet 18 that is an opposite side from a second side 68 of the first polymeric sheet 18 at which the second polymeric sheet 20 is fused. The first side 66 of the first polymeric sheet 18 is also the first side 40 of the bladder 12. For example, the formed bladder 12 may be placed in a separate mold assembly into which polymer foam is introduced to fill concave recesses 70 extending from the first side 66 at the portion 52, and to bond to the first side 66 of the first sheet 18 above the portions 52. The recesses 70 include the impressed areas 54. As shown in FIG. 6, side surfaces 72 of the first side 66 of the first polymeric sheet 18 are not covered by the foam layer 64 and remain exposed at medial side 74 and the lateral side 76 of the article of footwear 16. FIG. 7 shows the sole structure 14 in plan view, including the foam layer 64. The side surfaces 72 are exposed. It is also apparent in FIG. 7 that additional lugs 24 of various sizes can be formed by the mold assembly 10 such as by using larger diameter posts 32 and larger recesses 36. As previously discussed, although the lugs 24 are shown as generally round, the recesses 36 and posts 32 could have different shapes, such as but not limited to square, rectangular, or other polygonal shapes, or clusters of shapes, resulting in lugs having such different shapes.

A footwear upper 80, shown only in phantom in FIG. 6, can be secured to the foam layer 64 by adhesive, thermal bonding, or otherwise. An insole 82 is shown secured within the upper 80.

By utilizing the mold assembly 10 as described, a bladder 12 with an integral outsole 22 is provided. The thickness of the outsole 22 is sufficiently durable and maintains the integrity of the enclosed volume 44, which may contain pressurized fluid. Excess material of the polymeric sheets 18, 20 that flows during compression forming and thermoforming is directed to form the lug 24 by the mold assembly 10.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear, the sole structure comprising:

a bladder having a first side formed from a first polymeric sheet and a second side formed from a second polymeric sheet;

wherein the first polymeric sheet and the second polymeric sheet define a closed volume between the first side and the second side;

wherein the second polymeric sheet at least partially defines an outsole at the second side of the bladder, the outsole including a ground-contacting surface and a plurality of lugs; and wherein the first polymeric sheet includes a portion that extends from the first side of the bladder and is fused to the second polymeric sheet opposite the ground-contacting surface at the one of the plurality of lugs, the portion of the first polymeric sheet further defining the one of the plurality of lugs.

2. The sole structure of claim 1, further comprising:

a polymeric foam layer in contact with the first polymeric sheet; and wherein the polymeric foam layer and the second polymeric sheet are disposed on opposite sides of the first polymeric sheet.

3. The sole structure of claim 2, wherein the portion of the first polymeric sheet defines a concave recess extending from the first side; and wherein the polymeric foam layer fills the concave recess.

4. The sole structure of claim 1, wherein the portion of the first polymeric sheet extends within a recess of the second polymeric sheet at the one of the plurality of lugs.

5. The sole structure of claim 4, wherein the one of the plurality of lugs has a volume that is from about 10% to about 50% formed from the first polymeric sheet.

6. The sole structure of claim 1, wherein the first polymeric sheet includes an impressed area that is centrally located within the portion that is fused to the second polymeric sheet.

7. The sole structure of claim 6, wherein the impressed area extends further toward the second side than a remainder of the portion that is fused to the second polymeric sheet.

8. The sole structure of claim 1, wherein the first polymeric sheet is fused to the second polymeric sheet through compression molding.

9. The sole structure of claim 1, wherein the second polymeric sheet includes a thermoplastic polymer.

10. The sole structure of claim 9, wherein the outsole does not include rubber.

11. The sole structure of claim 1, wherein each of the first polymeric sheet and the second polymeric sheet respectively includes a thermoplastic polyurethane material.

12. The sole structure of claim 1, wherein the closed volume contains a fluid having a positive pressure relative to a standard atmospheric pressure.

13. The sole structure of claim 1, wherein each of the plurality of lugs has a solid portion having a height of from about 1 mm to about 5 mm.

* * * * *